US010213630B2

(12) United States Patent
Marz et al.

(10) Patent No.: US 10,213,630 B2
(45) Date of Patent: Feb. 26, 2019

(54) METHOD FOR THE CONTROL OF THE BREATHING GAS SUPPLY

(71) Applicant: B/E Aerospace Systems GmbH, Lübeck (DE)

(72) Inventors: Heiko Marz, Lübeck (DE); Thomas Sauerbaum, Groß Grönau (DE)

(73) Assignee: B/E Aerospace Systems GmbH, Lubeck (DE)

( * ) Notice: Subject to any disclaimer, the term of this patent is extended or adjusted under 35 U.S.C. 154(b) by 818 days.

(21) Appl. No.: 14/666,596

(22) Filed: Mar. 24, 2015

(65) Prior Publication Data

US 2015/0290481 A1 Oct. 15, 2015

(30) Foreign Application Priority Data

Apr. 9, 2014 (DE) ..... 10 2014 206 878

(51) Int. Cl.

| | |
|---|---|
| ***A62B 25/00*** | (2006.01) |
| ***A62B 18/02*** | (2006.01) |
| ***A62B 18/10*** | (2006.01) |
| ***A62B 9/02*** | (2006.01) |
| ***A62B 7/14*** | (2006.01) |

(52) U.S. Cl.

CPC ..... *A62B 25/005* (2013.01); *A62B 7/14* (2013.01); *A62B 9/02* (2013.01); *A62B 18/10* (2013.01); *A62B 18/02* (2013.01)

(58) Field of Classification Search

CPC .. B64D 2231/00; B64D 2231/02; A62B 7/14; A62B 9/02; A62B 18/00; A62B 18/02; A62B 18/10; A62B 25/005

See application file for complete search history.

(56) References Cited

U.S. PATENT DOCUMENTS 3,429,326 A 2/1969 Arnell et al.
2009/0014003 A1* 1/2009 Degenhardt ..... B64D 11/00 128/205.23

(Continued)

FOREIGN PATENT DOCUMENTS

CN 101415468 A 4/2009
CN 101415606 A 4/2009

(Continued)

OTHER PUBLICATIONS

Machine translation of EP 0394076 A1.*

(Continued)

*Primary Examiner* — (Jackie) Tan-Uyen T Ho
*Assistant Examiner* — Joseph D Boecker
(74) *Attorney, Agent, or Firm* — Donna P. Suchy

(57) ABSTRACT

The invention relates to a method for the control of the breathing gas supply, in particular of the oxygen supply, from a pressure-leading supply conduit (1) to one or more breathing masks (3) of an oxygen emergency supply device in an air vehicle, in particular in an aircraft, with which an on/off valve (2) is arranged between the supply conduit (1) and the one or the several breathing masks (3), with which valve the conduit connection can be blocked or released, with which a desired mass flow dependent on cabin pressure is set and the actual mass flow is detected, wherein in a first method step the valve (2) is activated in an opening manner until the error between the actual mass flow and the desired mass flow and which is summed over time exceeds a previously fixed maximal error value (4), whereupon the valve (2) in a second method step is activated in a closing manner until the error between the actual mass flow and the desired mass flow and which is summed over time exceeds of a previously fixed minimal error value (15), whereupon the cycle is repeated beginning with the first method step.

6 Claims, 3 Drawing Sheets

(56) References Cited

U.S. PATENT DOCUMENTS

| | | | | |
|---|---|---|---|---|
| 2010/0012123 | A1* | 1/2010 | Rittner | A62B 7/14 128/204.21 |
| 2013/0220317 | A1* | 8/2013 | Rittner | B64D 11/00 128/202.26 |
| 2017/0100611 | A1* | 4/2017 | Marz | A62B 7/02 |

FOREIGN PATENT DOCUMENTS

| | | | | |
|---|---|---|---|---|
| CN | 101616716 | A | 12/2009 | |
| CN | 105999577 | A | 10/2016 | |
| EP | 0394076 | A1 * | 10/1990 | A62B 7/14 |
| EP | 2143469 | A1 | 1/2010 | |
| EP | 2004294 | B1 | 7/2010 | |
| EP | 2630992 | A1 * | 8/2013 | A62B 7/08 |
| FR | 3019750 | A1 | 10/2015 | |

OTHER PUBLICATIONS

International Search Report and Written Opinion on International Application No. PCT/IB2017/056382 dated Feb. 8, 2018. 18 pages.

Anonymous: "Transactions in measurement and control, vol. 4, flow & level measurement", Dec. 31, 2001, pp. 1-116.

Chinese Search Report for CN2015101643351, dated Oct. 13, 2017, 1 page.

First Chinese Office Action for CN201510164335.1, dated Oct. 30, 2017, 9 pages.

French Search Report for FR1552887, dated Dec. 8, 2017, 6 pages.

German Examination Report for DE102014206878.9, dated Apr. 2, 2015, 3 pages.

German Examination Report for DE102014206878.9, dated Nov. 28, 2014, 1 page.

Partial International Search Report and Provisional Opinion for International Application PCT/IB2017/056382, dated Dec. 15, 2017, 9 pages.

Second Chinese Office Action for Chinese Patent Application No. 201510164335.1 dated Aug. 1, 2018. 12 pages.

* cited by examiner

METHOD FOR THE CONTROL OF THE BREATHING GAS SUPPLY

CROSS-REFERENCES TO RELATED APPLICATIONS

This application claims priority from German Patent Application No. 10 2014 206 878.9, filed Apr. 9, 2014 incorporated by reference in its entirety.

BACKGROUND

The invention relates to a method for controlling the breathing gas supply to one or more breathing masks of an emergency oxygen supply device, as well as to a device for the emergency supply of oxygen for carrying out this method.

A pressurised cabin, in which a cabin pressure ensuring the oxygen supply to the passengers amid an adequate supply of fresh air is envisaged with today's common jet aircraft which have a cruising altitude of 10,000 m and more. Emergency oxygen supply systems, with which the passengers can also be supplied with an adequate quantity of oxygen when a case of decompression arises, thus a drop in the cabin pressure, are provided in order to be able to ensure the supply of oxygen to the passengers given such an unexpected sudden pressure drop at such an altitude. Such systems typically comprise either pressurised oxygen containers or chemical oxygen generators which lead the breathing gas or oxygen via a conduit system to the breathing masks envisaged for the supply of the passengers, in an adequate quantity. Thereby, the emergency oxygen system is to be designed such that an adequate oxygen supply to the passengers is ensured at the maximal flight altitude to be expected. In contrast, the oxygen requirement reduces given a falling altitude, since the oxygen share in the surrounding air increases.

One constantly strives to keep the quantity of oxygen or breathing gas which is to be carried along as low as possible, since it is indeed the carrying-along of oxygen, be it in pressurised containers or in generators, which entails a significant weight which must be borne by the aircraft and reduces the payload capacity. In order to achieve this, the quantity of oxygen or breathing gas which is dispensed to the breathing masks is controlled in a manner dependent on cabin pressure according to pertinent regulations. In the case of decompression, the cabin pressure largely corresponds to the surrounding air pressure which is essentially dependent on altitude. The oxygen quantity which is to be fed to the passengers in a height-dependent manner, which is to say in a manner dependent on cabin pressure, is stipulated in the pertinent regulations. Thereby, one constantly strives not only to bring the oxygen quantity as close as possible to the minimum-prescribed value, in order to maintain the oxygen consumption as low as possible, but also to design the technical devices which are necessary in this context in an as lightweight and inexpensive as possible manner.

From EP 2 004 294 B1, it is counted as belonging to the state of the art, to control the oxygen supply to the breathing masks and which is dependent on cabin pressure, which is to say dependent on altitude, by way of an on/off valve, wherein the quantity control is effected by way of pulse width modulation of the valve.

The disadvantage thereby is that on the one hand the PID modules necessary for the production of the pulse-width modulation signal are relatively complicated, and on the other hand that the energy requirement for the actuation of the valves is comparatively high, since these are activated to open in very short succession, in dependence on the frequency of the pulse width modulation and need to be held in an opening manner for a while depending on the sampling degree. Accordingly, the valves must have a very high switching durability.

SUMMARY OF THE INVENTION

Against this background, it is the object of the invention to provide a method for controlling the breathing gas supply, which although on the one hand operates with such on/off valves which per se are inexpensive and robust, on the other hand however has a low energy consumption and is inexpensive to realise with regard to control technology.

Moreover, a device for the emergency supply of oxygen is to be provided, which operates according to such a method and is inexpensive in manufacture as well as economical in consumption of energy, but which at the same time permits an exact control, in order to maintain the oxygen consumption as low as possible.

The part of this object with regard to the device is achieved by a device for the emergency supply of oxygen with the features specified in claim 1. Advantageous developments of the invention are specified in the dependent claims, the subsequent description and the drawing. Thereby, the features specified in the dependent claims, and the description, in each case per se, but also in a suitable combination, can further form the solution according to the invention and according to claim 1.

The method according to the invention for the control of the breathing gas supply, in particular the oxygen supply from a pressure-leading supply conduit to one of more breathing masks of a emergency oxygen supply device in an air craft, in particularly in an aircraft, with which an on/off valve is arranged between the supply conduit and the one or the more breathing masks and with which valve the conduit connection can be blocked or released, envisages a desired mass flow dependent on cabin pressure being set, as is specified in pertinent regulations for the energy supply to the passengers, and the actual mass flow, thus the mass flow to the breathing mask or masks being determined. Thereby, according to the invention, in a first method step, the valve is activated in an opening manner for so long until the error between the actual mass flow and the desired mass flow and which is summed over the time exceeds previously fixed maximum error value, whereupon the valve in a second method step is activated in a closing manner until the error between the actual mass flow and the desired mass flow and which is summed over time exceeds a previously fixed minimal error value, whereupon the cycle is repeated beginning with the first method step.

The determining of the actual mass flow can be effected by way of a mass flow sensor or volume flow sensor for example, or also in another suitable manner. If for example a nozzle is arranged between the on/off valve and the one or more supply conduits to the breathing mask and this nozzle is designed such that in the expected operating range, it is subjected to throughflow supersonically, i.e. in an overcritical manner, then the pressure in front of the nozzle is essentially proportional to the mass flow, i.e. the mass stream through the nozzle, so that the mass flow to the passenger oxygen masks can be determined by way of the pressure.

The basic concept of the method according to the invention is thus not to modulate the sampling degree of the rectangular impulse, thus the width of the impulse, at a constant frequency, as with the state of the art, but to firstly activate the valve in an opening manner until the error between the actual mass flow and the pressure-dependently set desired mass flow and which is summed over time exceeds a previously fixed maximum error value, which is to say to hold the valve open for so long until more oxygen has been supplied to the breathing mask or breathing masks, than this would be necessary in a manner dependent on cabin pressure. Only when the actual mass flow, which means to say the oxygen quantity which is summed over time exceeds the desired oxygen quantity envisaged for this time by a certain amount, thus by a previously fixed maximal error valve, is the valve then changed over, in order in a second method step to activate this in a closing manner until the error between the actual mass flow and the desired mass flow and which is summed over time exceeds a previously fixed minimal error value, which means in order to keep the valve closed until less oxygen has been fed to the breathing mask or breathing masks than would be necessary in a manner dependent on cabin pressure, whereupon the cycle is repeated beginning with the first method step. Thereby, that which has been supplied in excess or that which has been supplied too little is taken into account with the subsequent method step. It is evident that the oxygen quantity which has been previously fed in excess due to the fixed error value is taken into account with the subsequent method step, in which the valve is activated to close, by way of the alternating changing-over of the valve, so that a very high closed-loop control accuracy can be achieved despite the comparatively short switching cycle number.

The method according to the invention is basically suitable per se for the control of the supply of breathing gas, which means that it can serve selectively for the control of the supply of a quasi infinite breathing gas, in particularly however of oxygen. On feeding oxygen, the breathing mask is provided with a breathing bag which is arranged upstream in a manner known per se and represents a buffer for the oxygen supply, as well as with an auxiliary air valve, as is basically counted as belonging to the state of the art.

It is to be understood that the method according to the invention, although functioning in dependence on an actual mass flow and a desired mass flow, these values however can also be realised by volume values, which means by a volumetric flow detection.

The desired mass flow according to an advantageous further development of the method according to the invention is determined by a computation unit, wherein the setting or target can be determined in dependence on the cabin pressure by way of values stored in tabular form, thus a table, by a curve or a algorithm. The cabin pressure here stands for flight altitude and the oxygen content of the surrounding air which results therefrom, and can basically also be detected with regard to measurement technology.

The method according to the invention is to be carried out such that an adequate oxygen supply of the passengers is always ensured. This is ensured if the actual mass flow measurement is effected continuously or in sufficiently short intervals for example of between one millisecond to 100 ms. The maximal error value is advantageously set between 10% and 100% above the desired mass flow. The greater this value, the lower is the number of switching cycles. The minimal error value should advantageously lie between 10% and 50% below the desired mass flow, where here too, it is the case that the switching frequency of the valve drops with an increasing error size.

Usefully, the error values should be selected such that with regard to the temporal average, the actual mass flow corresponds at least to the desired mass flow or is advantageously slightly greater, in order to ensure an adequate oxygen supply to the passengers under all circumstances.

Thereby, it is advantageous to select the error values such that after the first cycle, the actual mass flow corresponds to the desired mass flow or is larger than this.

The method according to the invention can reduce the switching frequency of the on/off valve in comparison to the method according to the state of the art. It can thus be applied with valves whose switching reliability is lower, or with the same switching reliability ensures an increased safety from failure.

A particularly advantageous application of the method according to the invention results if a bistable on/off valve, preferably a bistable on/off magnetic valve is used, since such a valve entails further energy savings, since then only one switching impulse needs to be produced for switching-over the valve, wherein no further energy is to be fed, particularly in the opened position, as is otherwise the case with simple magnet valves.

A device for carrying out the method according to the invention, as the present invention further envisages, comprises an oxygen storage device or a breathing gas storage device or an oxygen producer, a pressure conduit which leads oxygen or breathing gas, feeds one or more breathing mask and comprise an on/off valve, with which the pressure conduit can be opened or shut off. It further comprises means for determining the mass flow through the valve (actual mass flow) and control and regulation electronics which determine a desired mass flow in dependence on the signal of a cabin pressure sensor, and controls the valve in dependence on the determined actual mass flow. Thereby, the control and regulation electronics are adapted in order to be able to carry out the method according to the invention, which means for setting minimal and maximal error values. Moreover, the control and regulation electronics are designed in order to sum the actual mass flow over time and thus to determine the error value between the actual mass flow and the desired mass flow and to compare it with the previously fixed error values.

According to an advantageous further formation of the invention, the on/off valve is designed as a bistable on/off valve, preferably bistable on/off magnet valve. Such a magnet valve only requires one switching impulse for switching over, thus is extremely energy-saving in operation, which spares the electrical resources for the emergency supply.

The control and regulation electronics of the device according to the invention are advantageously designed for determining and/or setting error values, exceeding or falling short of which, the valve is switched over, for carrying out the method according to the invention. This means the control and regulation electronics are designed for the temporal summing of the determined actual mass flow as well as for setting which is to say specifying corresponding error values.

Basically, the number of the breathing masks which are connected on a pressure conduit is freely selectable, but it is particularly advantageous if two to six breathing mask are connected on a pressure-leading conduit and are activated by one on/off valve. Thereby, it is advantageous to let feed to the breathing masks be effected in each case via a breathing bag arranged upstream, as is basically counted as belonging to the state of the art with such devices.

The determining of the actual mass flow can advantageously be effected by way of a flow sensor, which is arranged in the conduit path between the on/off valve and the breathing mask, in particular the conduits connected to the breathing masks.

Since flow sensors are technologically comparatively complicated, according to a further development of the invention, it can be advantageous to arrange a valve downstream of the on/off valve and to dimension this nozzle in a manner such that a supersonic flow, i.e. overcritical flow, with which the flow quantity is essentially proportional to the pressure prevailing at the nozzle, sets in with the expected operating range. Then a pressure sensor is advantageously arranged between the on/off valve and the nozzle, wherein the actual mass flow is determinedly way of the temporal course of the pressure.

BRIEF DESCRIPTION OF THE DRAWINGS

The invention is hereinafter explained in more detail by way of an embodiment example which is represented in the drawing. There are shown in.

DETAILED DESCRIPTION OF THE PREFERRED EMBODIMENTS

Figure 1:
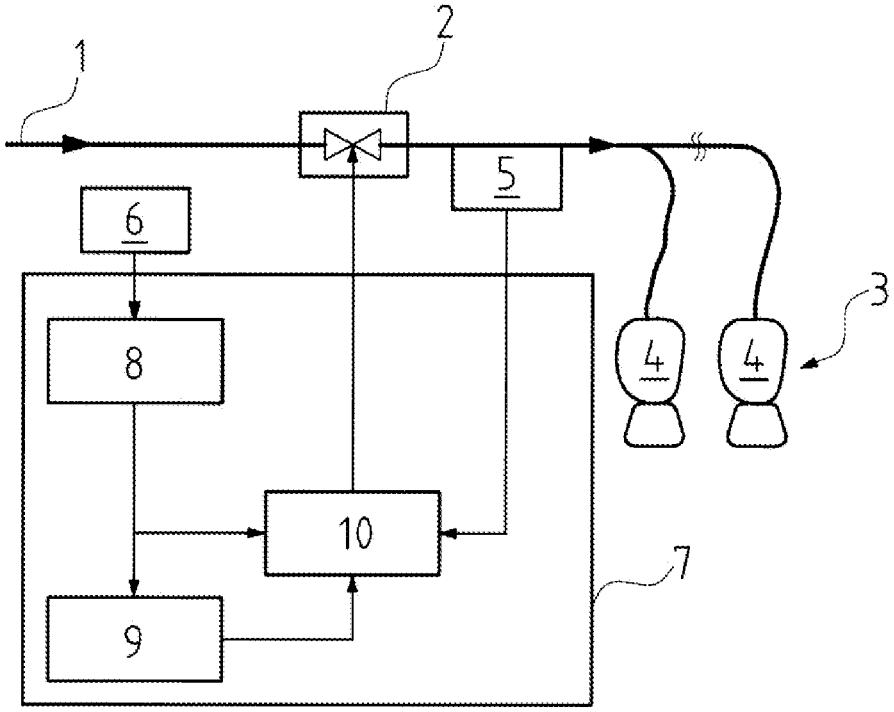
FIG. 1 a circuit diagram of a device for the emergency oxygen supply in an aircraft.

With the emergency oxygen supply device represented by way of FIG. 1, it is only that part which is of relevance to the present invention which is shown, beginning with a pressure-leading conduit 1 for oxygen, which is fed by a compressed gas bottle or an oxygen producer. This pressure-leading conduit 1 is connected via a bistable on/off magnet valve 2 to a group of breathing masks 3, of which here two are shown by way of example. With regard to the breathing masks 3, it is the case of the passenger oxygen masks which are common in civilian air travel and are with a breathing bag 4 arranged upstream. A flow mass meter 5 is provided in the conduit to the breathing masks 3, at the exit side of the magnet valve 2, and this meter detects the actual mass flow. Moreover, a pressure sensor 6 is provided, which detects the cabin pressure within the aircraft. A control and regulation unit 7 is provided, which controls the magnet valve 2 in dependence on the signal of the pressure sensor 6 as well as on the signal of the flow mass meter 5.

The control and regulation unit 7 is formed by a microprocessor, in which in a first computation unit 8 the desired mass flow is determined by way of values stored in tabular form and the cabin pressure determined via the pressure sensor 6, said desired mass flow being necessary at this cabin pressure, in order to supply the connected breathing masks 3 or the persons connected thereto, with the required quantity of oxygen. A second computation unit 9 is provided, which determines the desired values (setpoints) and error values for the closed-loop control, by way of the desired mass flow determined by way of the first computation unit 8. The mass flow over time is summed in a third computation unit 10 by way of the signals of the flow mass meter 5, and the current or actual error value to the desired mass flow is determined. A maximal and minimal error value are set in the third computation unit 10, and when these are reached the magnet valve 2 receives a switching impulse for change-over.

Figure 2:
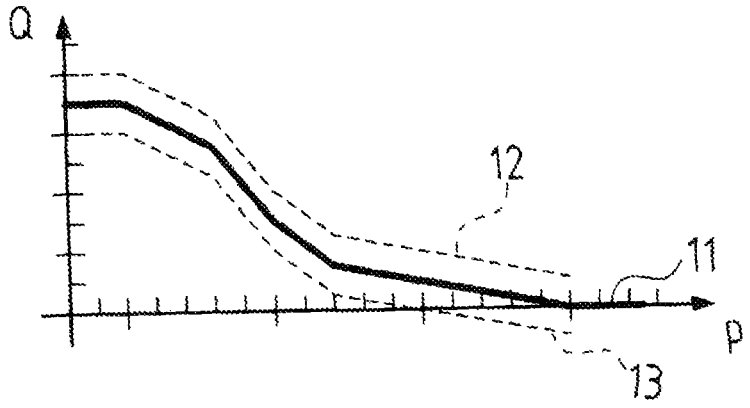
FIG. 2 a curve which shows the desired mass flow in dependence on the cabin pressure.

FIG. 2 shows a diagram which in the unbroken line represents the desired mass flow in dependence on the cabin pressure, which is to say in dependence on the flight altitude or the surrounding pressure. This curve 11 is stored in the computation unit 8. A likewise pressure-dependent maximal error in a curve 12 is represented with respect to this curve 11. A minimal error in a curve 13 is represented below the curve 11. The curves 12 and 13, as FIG. 2 clearly shows, in their course follow the curve 11 which represents the desired mass flow in dependence on the cabin pressure, but are shifted by a certain amount to the top (curve 12) or to the bottom (curve 13), thus mark the error band or tolerance band around the curve 11. These curves 12 and 13 are stored in the computation unit 10.

Figure 4A:
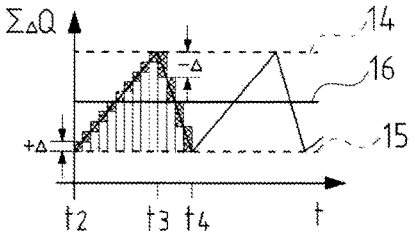
FIG. 4*a*, 4*b* the detail A of FIGS. 3*a* and 3*b*, in an enlarged representation.
Figure 4B:
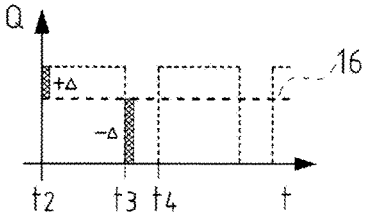
Figure 3A:
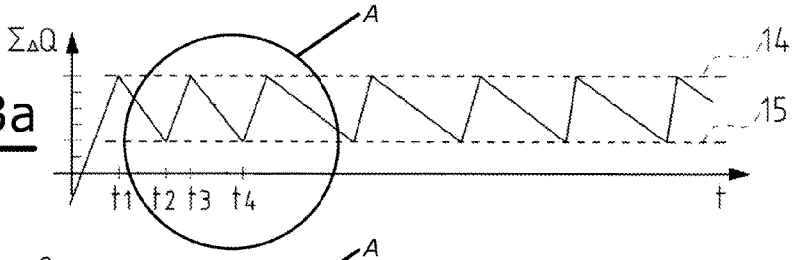
FIG. 3 three diagrams which correspond with regard to the temporal course; and specifically FIG. 3*a* the summed actual mass flow.
FIG. 3*b* the actual mass flow over time.
FIG. 3*c* the switching impulses for switching over the valve, over time.
Figure 3B:
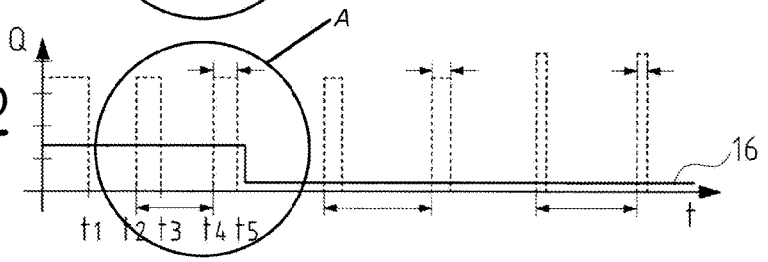
Figure 3C:
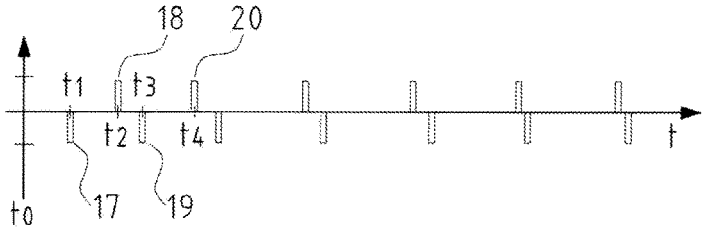

The control of the valve 2 is specifically represented by way of FIGS. 3 and 4, wherein a maximal error value 14 is derived from the curve 12 and a minimal error value 15 is derived from the curve 13, in FIGS. 3*a* and 4*a* respectively. The curve 16 in FIGS. 3*b* and 4*b* represents the desired mass flow.

Beginning with the emergency oxygen supply, the valve 2 is activated to open firstly at the point in time $t_0$. By way of this, oxygen flows through the conduit 1 and the opened valve 2 to the breathing masks 3. The quantity of the oxygen flowing through is detected via the flow mass sensor 5, and the error value resulting with respect to the desired mass flow is temporally summed in the computation unit 10. The summing is represented by way of FIGS. 3*a* and 4*a*. Thereby, firstly initially an undersupply is to be ascertained, until, with an opened valve 2, the actual mass flow flowing through the valve has exceeded the desired mass flow and has reached the maximal error value 14. At this point in time $t_1$, the valve 2 is change-over by way of a switching impulse 17, whereupon it is closed and thus no further oxygen flows to the breathing masks 3. An increasing error value results with an increasing time on account of this, which is to say that firstly a reduction of the oversupply of the preceding switching interval, and then an undersupply with respect to the desired value or setpoint 16, until finally this is fallen short of and a minimal error value 15 is reached, which is stored in the control and regulation unit 7, in particular the computation unit 10. As soon as this minimal error value has been reached, which is to say when the curve 13 has been reached and is just fallen short off, thus when the minimal error value 15 is reached or just fallen short of with regard to magnitude, specifically at the point in time $t_2$, then the valve 2 is reversed by way of a switching impulse and from now on is opened, so that oxygen flows through the conduit 1 to the breathing masks 3. With this, firstly the past undersupply is covered, wherein with increased time and with an opened valve 2, more oxygen flows through than is envisaged according to the desired value (setpoint) curve 16. This is effected until the mass flow has reached a maximal error value 14, specifically at the point in time $t_3$, and the magnet valve 2 is switched over again by way of a switching impulse 19 which means is closed. If thereafter, the desired curve 16 is firstly fallen short of due to an undersupply and finally the minimal error value 15 is reached, at the point in time $t_4$ a switching impulse 20 is issued by the computation unit 10 which switches over the magnet valve 2 which is to say now activates to open, so that the oxygen flows again. This method is continuously repeated so that with a suitable sampling rate, preferably between 1 and 200 ms, here for example 5 ms, an oxygen supply is reached, which practically exactly corresponds to the desired supply.

As FIG. 3*b* in particular shows, on the one hand the switching procedures per se are comparatively low, since the valve 2 is merely switched over on reaching a maximum or minimum error, but no high-frequency activation of the valve is necessary, as is common with pulse width modulation. The activation is moreover significantly better adapted to the actual oxygen requirement, since the method is not limited to a frequency and a sampling degree, as is necessary with pulse width modulation.

The previously described closed-loop control method sums the errors of the control variable for the control of the bistable on/off magnet valve 2. Thereby, the error value is summed into a desired value (setpoint) which is determined in a pressure-dependent manner in the first computation unit 8 by way of predefined values. If the error sum reaches the upper error value 14 given an opened valve 2, then the valve is reversed. Only when the error sum reaches the lower defined error value 15 is the valve again switched over and thus opened. Thus it is always only one energy impulse which is required for the switching, not for the holding of the opened valve, as can be clearly recognised by way of FIG. 3*c*.

The previously described method can also be used without any problem if the desired mass flow changes, if for example the aircraft is in descent, since then the maximal and the minimal error value according to the curves 12 and 13 is adapted, and due to the summing of the error values, it is always ensured that the desired mass flow is also achieved. This closed-loop control is largely insensitive to disturbance parameters and avoids the inherent problems of a PID closed-loop control as is typically applied with the state of the art.

LIST OF REFERENCE NUMERALS

1—pressure-leading conduit
2—bistable on/off magnet valve
3—breathing masks
4—breathing bag
5—flow mass meter
6—pressure sensor
7—control and regulation unit
8—first computation unit
9—second computation unit
10—third computation unit
11—desired curve
12—curve of maximal error values
13—curve of minimal error values
14—maximal error value
15—minimal error value
16—desired value
17—switching impulses
18—switching impulses
19—switching impulses
20—switching impulses

The invention claimed is:

1. A device for emergency oxygen supply in an air vehicle, comprising:

a gas storage device including at least one of (i) an oxygen storage device, (ii) a breathing gas storage device, or (iii) an oxygen generator;

a pressure-conduit which receives at least one of oxygen or breathing gas from the gas storage device and which provides the at least one of the oxygen or breathing gas to one or more breathing masks;

an on/off valve with which the pressure conduit can be opened or blocked; and control and regulation electronics configured to:

receive a cabin pressure value from a pressure sensor;

determine a maximum mass flow based on the cabin pressure value;

determine a minimum mass flow based on the cabin pressure value;

receive an actual mass flow from a mass flow meter;

compare the actual mass flow to the maximum mass flow and the minimum mass flow;

responsive to the actual mass flow exceeding the maximum mass flow, cause the on/off valve to block the pressure conduit; and responsive to the actual mass flow falling below the minimum mass flow, cause the on/off valve to open the pressure conduit.

2. The device of claim 1, wherein the on/off valve is a bistable on/off valve.

3. The device of claim 1, wherein the control and regulation electronics are configured to at least one of determine or set error values exceeding or falling short of which the on/off valve is changed over.

4. The device of claim 1, wherein each breathing mask receive the at least one of the oxygen or the breathing gas via a breathing bag arranged upstream of the breathing mask.

5. The device of claim 1, comprising a nozzle arranged downstream of the on/off valve, and the pressure sensor is provided between the on/off valve and the nozzle.

6. The device of claim 2, wherein the on/off valve is a magnet valve.

* * * * *